US012734391B2

(12) United States Patent
Jiang et al.

(10) Patent No.: US 12,734,391 B2
(45) Date of Patent: Sep. 15, 2026

(54) ROTATABLE AND ADJUSTABLE DUMBBELL

(71) Applicant: Xinjiashang (Dezhou) Fitness Technology Co., Ltd., Dezhou City (CN)

(72) Inventors: Chun Jiang, Dezhou City (CN); Shangwei Chen, Dezhou City (CN); Yong Jiang, Dezhou City (CN)

(73) Assignee: Xinjiashang (Dezhou) Fitness Technology Co., Ltd., Dezhou City (CN)

( * ) Notice: Subject to any disclaimer, the term of this patent is extended or adjusted under 35 U.S.C. 154(b) by 29 days.

(21) Appl. No.: 19/077,400

(22) Filed: Mar. 12, 2025

(65) Prior Publication Data

US 2025/0332465 A1 Oct. 30, 2025

(30) Foreign Application Priority Data

Apr. 28, 2024 (CN) ..... 202420906731.1

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ..... A63B 21/00058; A63B 21/00065; A63B 21/062; A63B 21/0624; A63B 21/0726;
(Continued)

(56) References Cited

U.S. PATENT DOCUMENTS 12,594,453 B2 * 4/2026 Jiang ..... A63B 21/075
2010/0304938 A1 * 12/2010 Olson ..... A63B 21/0728 482/107

(Continued)

FOREIGN PATENT DOCUMENTS

CN 209997094 U * 1/2020
CN 213252793 U * 5/2021

(Continued)

*Primary Examiner* — Gary D Urbiel Goldner
(74) *Attorney, Agent, or Firm* — Hawaii Patent Services; Nathaniel K. Fedde; Kenton N. Fedde

(57) ABSTRACT

A rotatable and adjustable dumbbell, with radial grooves and radial protrusions arranged on left and right sides of dumbbell plates respectively, more than two groove-end axial baffle plates evenly arranged on the radial grooves, inner connecting grooves arranged inside the groove-end axial baffle plates, more than two protrusion-end axial baffle plates evenly provided on outer end surfaces of the radial protrusions, and outer connecting grooves provided in the protrusion-end axial baffle plates. The dumbbell plates and an inner end plate are both provided with guide grooves at outer diameters, a lower portion of lock button switches is provided with at least one connecting gap and at least one connecting protrusion, at least one guide plate and at least one inner guide groove are provided inside the dumbbell plates, the guide plate is inserted into the connecting gap, and the connecting protrusion is inserted into the inner guide groove.

5 Claims, 5 Drawing Sheets

(58) Field of Classification Search
CPC ..... A63B 21/0728; A63B 21/075; A63B 71/0054; A63B 2244/09
See application file for complete search history.

(56) References Cited

U.S. PATENT DOCUMENTS

| | | | | |
|---|---|---|---|---|
| 2010/0304939 | A1* | 12/2010 | Svenberg | A63B 21/075 482/108 |
| 2010/0304940 | A1* | 12/2010 | Svenberg | A63B 21/075 482/108 |
| 2010/0323856 | A1* | 12/2010 | Svenberg | A63B 21/075 482/108 |
| 2011/0092345 | A1* | 4/2011 | Svenberg | A63B 21/063 482/107 |
| 2014/0005012 | A1* | 1/2014 | Wang | A63B 21/0726 482/108 |
| 2015/0297936 | A1* | 10/2015 | Madden | A63B 21/0728 482/107 |
| 2015/0367164 | A1* | 12/2015 | Myre | A63B 21/0726 482/139 |
| 2025/0010121 | A1* | 1/2025 | Jiang | A63B 21/075 |
| 2025/0375652 | A1* | 12/2025 | Jiang | A63B 21/0726 |

FOREIGN PATENT DOCUMENTS

| | | | | |
|---|---|---|---|---|
| CN | 214714051 U | * | 11/2021 | A63B 24/0087 |
| WO | WO-2012058612 A1 | * | 5/2012 | A63B 21/075 |
| WO | WO-2023097859 A1 | * | 6/2023 | A63B 21/075 |

* cited by examiner

ROTATABLE AND ADJUSTABLE DUMBBELL

INCORPORATION BY REFERENCE

This application claims the benefit of priority from China Patent Application No. 202420906731.1 filed on Apr. 28, 2024, the contents of which are hereby incorporated by reference in their entirety.

TECHNICAL FIELD

The present disclosure relates to the technical field of sports equipment, and in particular to a rotatable and adjustable dumbbell.

BACKGROUND TECHNOLOGY

Among the available fitness equipment, the most commonly used equipment for arm strength is dumbbell. In order to adjust weight of the dumbbells, it is customary to increase or decrease the weight of the dumbbells by means of using removable and adjustable dumbbells. At present, the more common way is to realize a replacement of dumbbell plates by inserting or threading.

When the user increases or decreases the dumbbell plates by screwing, disadvantages are that operation efficiency is low, and fixed dumbbell plates are prone to loosen when continuously used or shaken, there is a potential safety hazard, and the loosened dumbbell plates will shake as a whole, resulting in poor user experience.

The disadvantage of increasing or decreasing the number of dumbbells by means of insertion connection is that, since an insertion connection structure is axial, when the dumbbells are set in a round shape, the dumbbells will roll on a floor or platform if the dumbbells are not placed on the fixed device during use. Referring to utility model number 2022205212694, when a switch on the dumbbells is rolled vertically downward, if the switch is loose or the locking is not firm, the dumbbell plate will be loosened. Furthermore, a locking structure of this dumbbell structure adopts an axial transverse locking buckle, and a locking function of the locking buckle is realized by a combination of vertical restraint and transverse spring restraint. In actual operation, the locking buckle structure provided by the structure is prone to shake, resulting in unsatisfactory locking effect and poor user experience.

In view of the above drawbacks, based on market feedbacks, the technical developers in this field believe that it is strongly necessary to make structural adjustments on the basis of the existing rotatable and adjustable dumbbell, and improve a combination structure of the dumbbell plates and a guiding structure of the locking buckles to overcome or solve technical problems encountered in the prior art.

SUMMARY OF THE INVENTION

In order to overcome the inadequacy of the prior art, the present disclosure discloses a rotatable and adjustable dumbbell, adopting a screwing and insertion connection structure for dumbbell plates and a traverse guiding restraining structure for a locking buckle in conjunction with each other, with a purpose of effectively improving the stability of the assembled dumbbell and the comfort of operation and the safety of use.

For achieving the above technical objectives, the present disclosure adopts following technical solutions: A rotatable and adjustable dumbbell comprising a handle with inner end plates fixed on both sides of the handle, wherein a plurality of dumbbell plates are arranged outside the inner end plates; radial grooves and radial protrusions are arranged on left and right sides of the dumbbell plates respectively, more than two groove-end axial baffle plates are evenly arranged on outer end surfaces of the radial grooves, inner connecting grooves are arranged inside the groove-end axial baffle plates, inner radial baffle plates are arranged at ends of the inner connecting grooves; outer end surfaces of the radial protrusions are evenly provided with more than two protrusion-end axial baffle plates, inner sides of the protrusion-end axial baffle plates are provided with outer connecting grooves, and outer radial baffle plates are arranged at ends of the outer connecting grooves; the inner end plates are provided with radial grooves or radial protrusions facing the dumbbell plates;

the dumbbell plates and the inner end plate are both provided with slots at outer diameters for restraining axial movement of lock button switches arranged in the slots, a lower portion of the lock button switches is provided with at least one connecting gap and at least one connecting protrusion, at least one guide plate and at least one inner guide groove are provided inside the dumbbell plates to fit with the lock button switches, the guide plate is inserted into the connecting gap, the connecting protrusion is inserted into the inner guide groove, at least one axial elastic component is provided between the lock button switches and the dumbbell plates.

The groove-end axial baffle plates and the inner radial baffle plates are both set with a graduated thickness, progressively becoming thicker from radial ends of bodies of baffle plates to radial interior portions of the baffle plates.

At least one screwing mark is provided on the radial grooves and the radial protrusions or on either of the radial grooves and the radial protrusions, with the screwing mark used to guide operators to screw and lock.

The dumbbell plates and the lock button switches are correspondingly provided with spring fixing parts adopting protrusions or grooves, and the two spring fixing parts are connected with each other to fix elastic parts.

The inner guide groove comprises two side plates arranged opposite to each other, and the connecting protrusion is inserted into a gap between the two side plates. Beneficial effects of the present disclosure are as follows: the present disclosure discloses a rotatable and adjustable dumbbell, radial grooves and radial protrusions are arranged on left and right sides of the dumbbell plates respectively, more than two groove-end axial baffle plates are evenly arranged on outer end surfaces of the radial grooves, and inner connecting grooves are arranged inside the groove-end axial baffle plates. Outer end surfaces of the radial protrusions are evenly provided with more than two protrusion-end axial baffle plates, and inner sides of the protrusion-end axial baffle plates are provided with outer connecting grooves. The radial grooves and the radial protrusions are assembled by insertion connection and screwing, and radial loosening after assembly can be effectively avoided without external force. The dumbbell plates and the inner end plate are both provided with guide grooves at outer diameters for restraining axial movement of lock button switches arranged in the guide grooves, a lower portion of the lock button switches is provided with at least one connecting gap and at least one connecting protrusion, at least one guide plate and at least one guide groove are provided inside the dumbbell plates to fit with the lock button switches, the guide plate is inserted into the connecting gap, and the connecting protrusion is inserted into the guide groove. With the above structure, the axial movement of the lock button switches will not shake and be more stable when locked, resulting in a better user experience.

Figure 1:
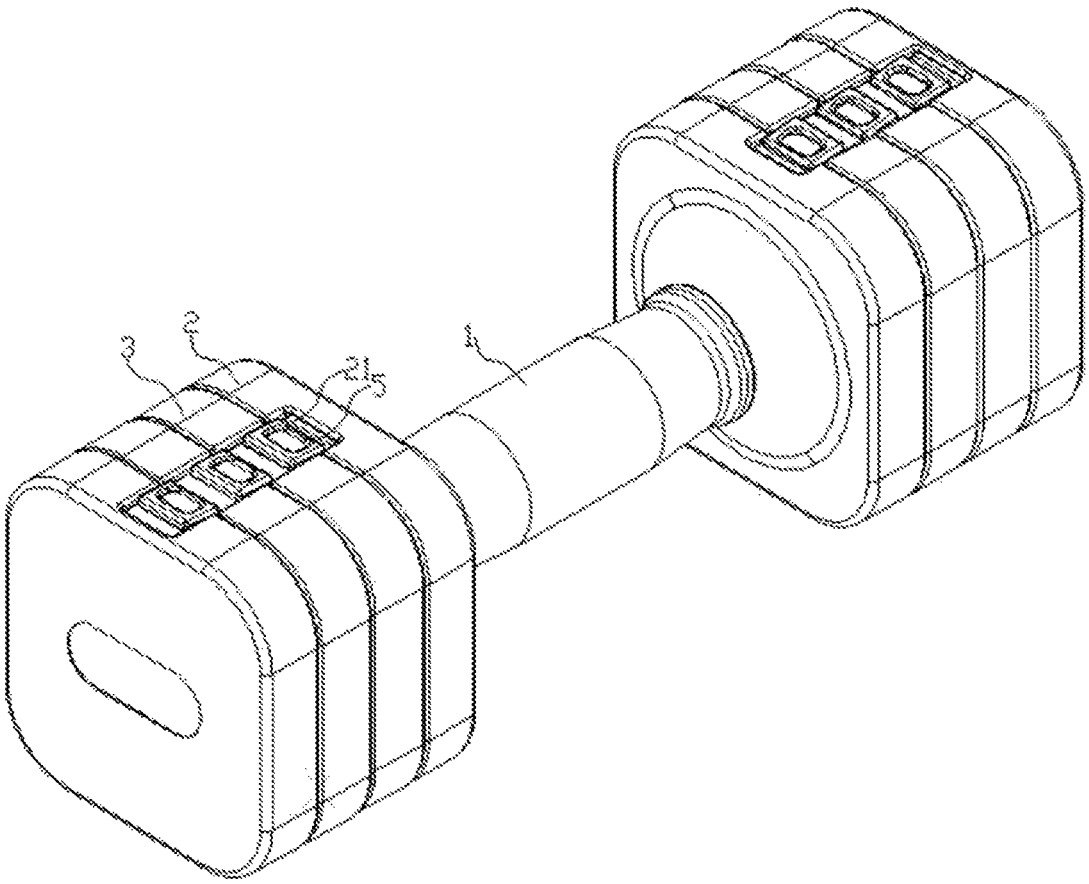
FIG. 1 shows a schematic diagram of a three-dimensional appearance structure of the present disclosure.

The reference signs in the figures are indicated as follows:

1—handle; 2—inner end plate; 21—inner end plate locking groove; 3—dumbbell plate; 31—outer guide groove; 32—guide plate; 33—side plate; 34—inner spring fixing part; 4—screwing mark; 5—lock button switch; 50—pressure surface groove; 51—vertical connecting part; 52—connecting protrusion; 53—connecting gap; 54—outer spring fixing part; 6—radial groove; 61—groove-end axial baffle plates; 62—inner radial baffle plate; 63—inner connecting groove; 7—radial protrusion; 71—protrusion-end axial baffle plate; 72—outer radial baffle plate; 73—outer connecting groove.

SPECIFIC EMBODIMENTS

The present disclosure is described in detail below by means of specific embodiments, but it should be pointed out that the following specific embodiments do not technically limit the present technical solution. Those skilled in the art may make further technical extensions under the guidance of the following technical solution.

A rotatable and adjustable dumbbell, as shown in the accompanying drawings, comprising a handle 1, adopts a same structural design as the prior art. Inner end plates 2 are fixed on both sides of the handle 1, and the inner end plates and the handle 1 are integrated or assembled by insertion connection, and can also be pasted or screwed. In this embodiment, no specific structural limitation of the prior art is made, and those skilled in the art may carry out structural setting and assembly on their own under the guidance of the above specification.

A plurality of dumbbell plates 3 are arranged outside the inner end plates 2 and radial grooves 6 and radial protrusions 7 are arranged on left and right sides of the dumbbell plates 3 respectively. In this embodiment, the radial grooves 6 and the radial protrusions 7 are either arranged coaxially or symmetrically, enabling the radial grooves 6 and radial protrusions 7 on the plurality of the dumbbell plates 3 to be combined with each other in a serial manner during assembly.

Figure 2:
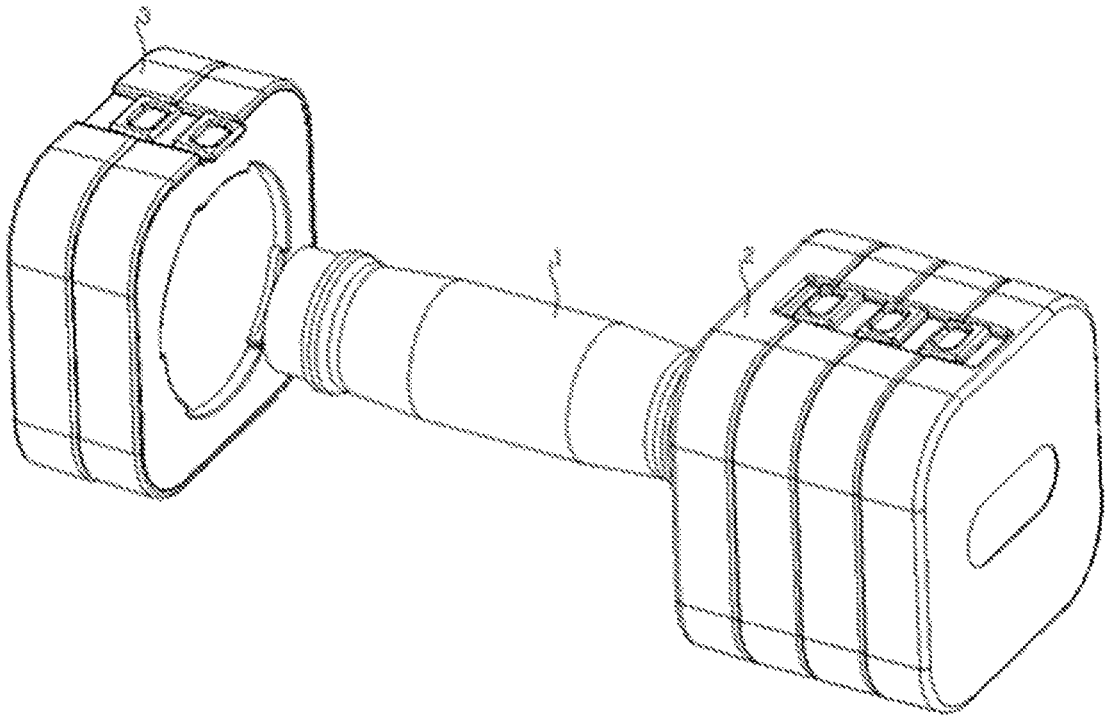
FIG. 2 shows a schematic diagram of a three-dimensional disassembled structure of the present disclosure.
Figure 3:
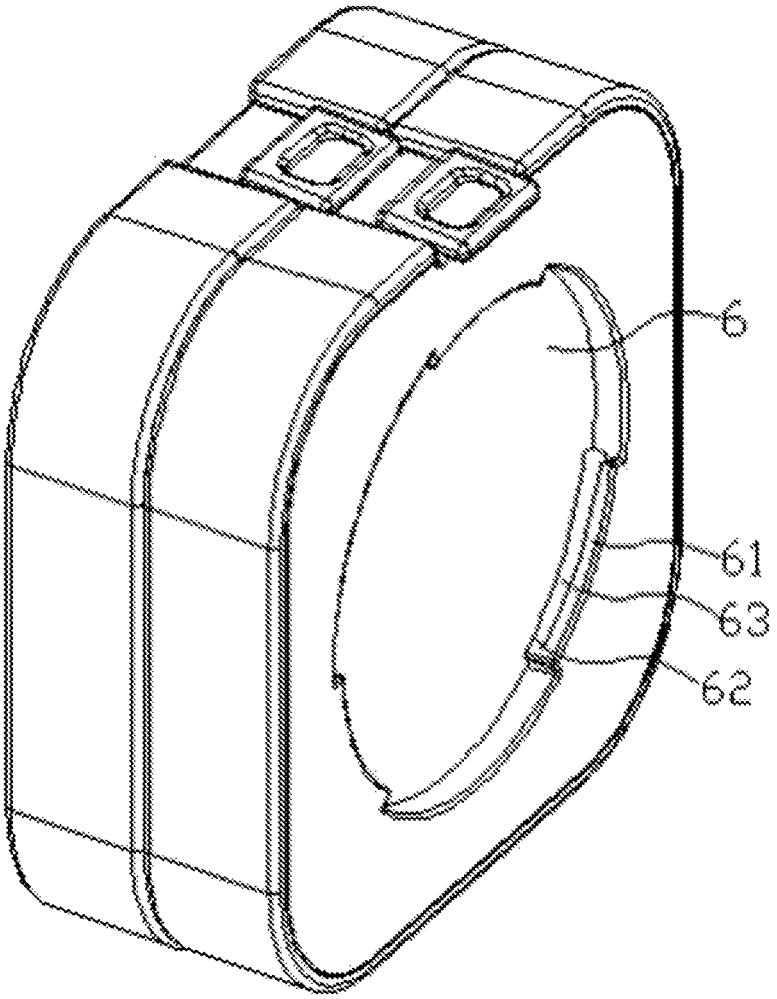
FIG. 3 shows a schematic diagram of a three-dimensional structure of radial grooves on dumbbell plates

As shown in FIGS. 2 and 3, three groove-end axial baffle plates 61 are evenly arranged on outer end surfaces of the radial grooves 6, inner connecting grooves 63 are arranged inside the groove-end axial baffle plates 61, inner radial baffle plates 62 are arranged at ends of the inner connecting grooves 63. With this structure, connecting grooves 63 with one open end can be formed on inner sides of the groove-end axial baffle plates 61, and when the radial grooves 6 and the radial protrusions 7 are screwed to lock, fixed-point locking can be realized without causing loosening after screwing.

Figure 4:
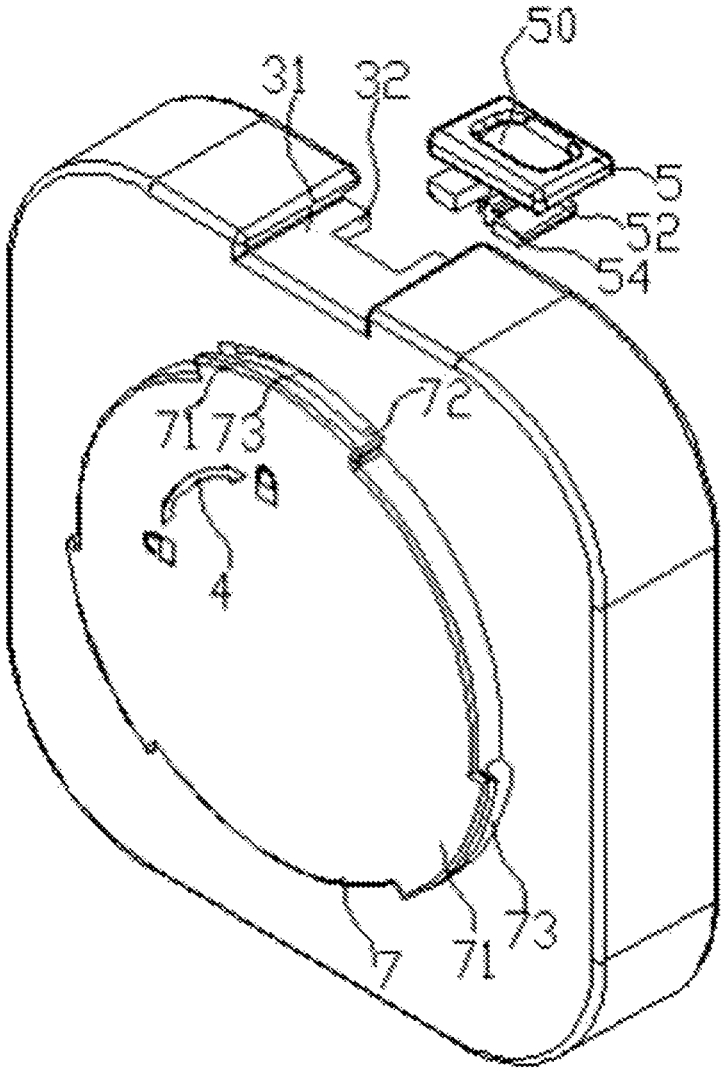
FIG. 4 shows a schematic diagram of the three-dimensional structure of radial protrusions on the dumbbell plates.

As shown in FIG. 4, corresponding to the radial grooves 6, outer end surfaces of the radial protrusions 7 are evenly provided with three protrusion-end axial baffle plates 71, inner sides of the protrusion-end axial baffle plates 71 are provided with outer connecting grooves 73, and outer radial baffle plates 72 are arranged at ends of the outer connecting grooves 73.

After above structural settings are adopted, when assembling, the radial grooves 6 and the radial protrusions 7 on adjacent dumbbell plates 3 are coaxially corresponding and radially staggered to achieve axial insertion connection, with the groove-end axial baffle plates 61 screwed into the outer connecting grooves 73 and the protrusion-end axial baffle plates 71 screwed into the inner connecting grooves 63 synchronously. The assembly of the inner radial baffle plates 62 and outer radial baffle plates 72 are achieved when a screwed state reaches the point where the inner radial baffle 62 and the outer radial baffle 72 are integrated by pressing. This structure is more stable than an insertion connection structure in the prior art, and after insertion connection is completed, no matter whether the dumbbell plates are square, circular or polygonal, as long as there is no spiral screwing force in a radial direction, assembled dumbbell plates cannot be loosened.

Further to the above structure, the groove-end axial baffle plates 61 and the inner radial baffle plates 62 are both set with a graduated thickness, progressively becoming thicker from radial ends of bodies of baffle plates to radial interior portions of the baffle plates. The bodies of baffle plates presented in this embodiment refer to the groove-end axial baffle plates 61 and the inner radial baffle plates 62. With the above structural arrangement, the groove-end axial baffle plates 61 and the inner radial baffle plates 62 can be tightened when the groove-end axial baffle plates 61 and the inner radial baffle plates 62 are fitted and screwed, and the tightening of a combination of the groove-end axial baffle plates 61 and the inner radial baffle plates 62 can be further promoted.

Figure 5:
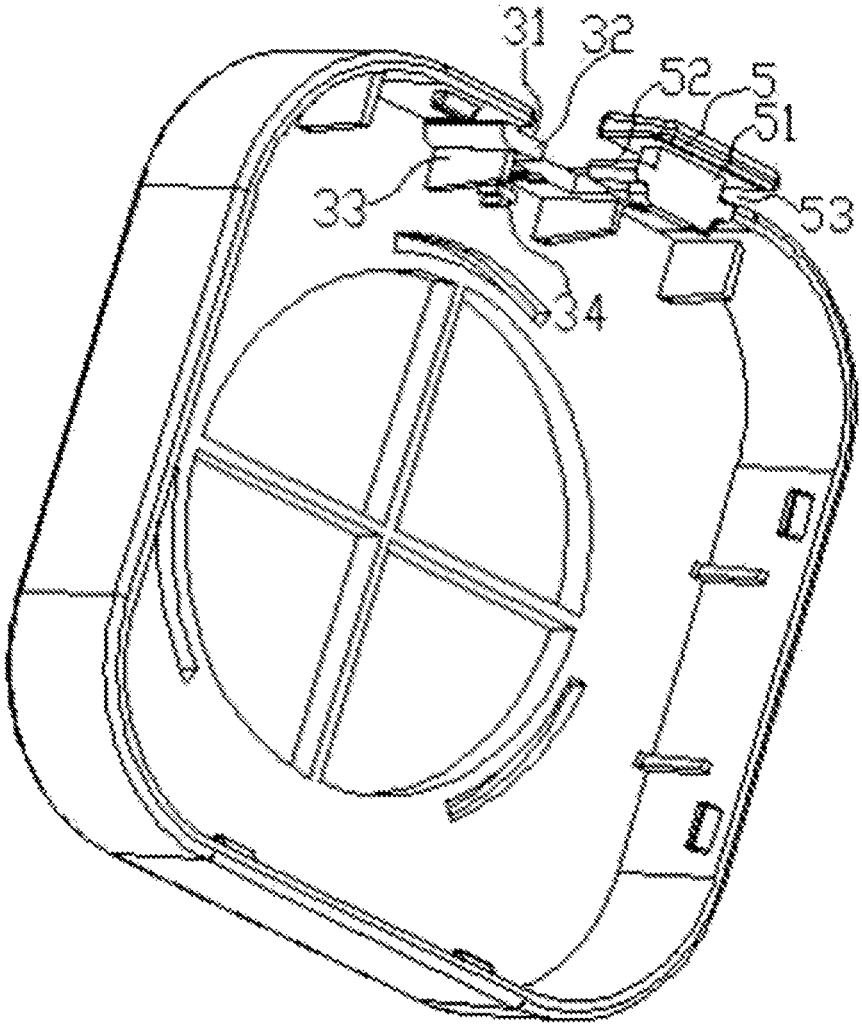
FIG. 5 shows a schematic diagram of an assembled structure of lock button switches.

Another technical improvement of the present disclosure is that both the dumbbell plates 3 and the inner end plates 2 are provided with grooves for restricting axial movement of the lock button switch 5 at outer diameters, with the grooves comprising outer guide grooves 31 and inner end plate locking grooves 21. The lock button switches 5 are provided in the outer guide grooves 31, as shown in FIGS. 4 and 5, lower portions of the lock button switches 5 are provided with at least one vertical connecting part 51, a lower portion of the vertical connecting part 51 is connected with horizontally arranged connecting protrusion 52, and front and rear side portions of the vertical connecting part 51 are provided with connecting gaps 53. The guide plate 32 and the inner guide groove are arranged inside the dumbbell plates 3 with the lock button switches 5, the inner guide groove in this area comprises two side plates 33 which are oppositely arranged, and the inner guide groove formed between the connecting protrusion 52 and the two side plates is inserted and guided. After the above structure is arranged, the guide plate 32 and the connecting gap 53 are connected by insertion, and the inner guide groove and the connecting projection 52 are connected by insertion. The lock button switches 5 and the dumbbell plates 3 are respectively provided with at least one inner spring fixing part 34 and at least one outer spring fixing part 54, and a spring is arranged between the inner spring fixing part 34 and the outer spring fixing part 54 as an axial elastic component. The inner spring fixing part 34 and the outer spring fixing portion 54 in this embodiment are both columnar protrusions or polygonal columnar protrusions, with a main purpose of inserting the spring and prevent the spring from moving. On this basis, those skilled in the art can also use grooves for fixing springs, and effects of two schemes are equal.

In order to realize an assembly of the inner end plates 2 and the dumbbell plates 3, the present disclosure provides radial protrusions 7 on the inner end plates 2 facing the dumbbell plates 3, and radial grooves 6 are provided on the dumbbell plates 3 corresponding to one side of the inner end plates 2, which can realize fixation of the dumbbell plates on the inner end plates 2. Under guidance of this technical solution, those skilled in the art can also provide the radial grooves 6 on the inner end plates 2 towards the dumbbell plates 3, and the radial protrusions 7 are provided on the dumbbell plates 3 on one side corresponding to the inner end plates 2, with a better insertion connection effect. The above structure enables the axial movement of the lock button switches 5 not wobble and more stable when locked, producing a better user experience.

Further, at least one screwing mark 4 is provided on the radial grooves 6 and/or the radial protrusions 7. Those skilled in the art set the screwing mark 4 on the radial protrusions 7. Since the radial protrusions 7 are convex, it is easier for the skilled person to observe, and a screwing direction can be defined according to the screwing mark 4, and the operator can be further guided to realize assembly of the plurality of dumbbell plates 3.

What is claimed is:

1. A rotatable and adjustable dumbbell, comprising:

a handle with inner end plates fixed on opposing sides of the handle, wherein a plurality of dumbbell plates are arranged outside each of the inner end plates;

radial grooves and radial protrusions arranged on left and right sides of each of the plurality of dumbbell plates respectively, wherein:

more than two groove-end axial baffle plates are respectively and evenly arranged on outer end surfaces of the radial grooves, inner connecting grooves are respectively arranged inside the more than two groove-end axial baffle plates, and inner radial baffle plates are respectively arranged at ends of the inner connecting grooves;

outer end surfaces of the radial protrusions are respectively and evenly provided with more than two protrusion-end axial baffle plates, inner sides of the more than two protrusion-end axial baffle plates are respectively provided with outer connecting grooves, and outer radial baffle plates are respectively arranged at ends of the outer connecting grooves; and the inner end plates are respectively provided with radial grooves or radial protrusions facing the plurality of dumbbell plates;

wherein the plurality of dumbbell plates and the inner end plates are both provided with slots at outer diameters thereof for restraining axial movement of lock button switches respectively arranged in the slots, a lower portion of each of the lock button switches is provided with at least one connecting gap and at least one connecting protrusion, at least one guide plate and at least one inner guide groove are provided inside each of the plurality of dumbbell plates to respectively fit with the lock button switches, the at least one guide plate is inserted into the at least one connecting gap, the at least one connecting protrusion is inserted into the at least one inner guide groove, and at least one axial elastic component is respectively provided between the lock button switches and the plurality of dumbbell plates.

2. The rotatable and adjustable dumbbell according to claim 1, wherein the more than two groove-end axial baffle plates and the inner radial baffle plates are both set with a graduated thickness, progressively becoming thicker from radial ends of bodies of the more than two groove-end axial baffle plates and the inner radial baffle plates to radial interior portions of the more than two groove-end axial baffle plates and the inner radial baffle plates.

3. The rotatable and adjustable dumbbell according to claim 1, wherein at least one screwing mark is provided on the radial grooves and the radial protrusions or on either of the radial grooves and the radial protrusions.

4. The rotatable and adjustable dumbbell according to claim 1, wherein the plurality of dumbbell plates and the lock button switches are each correspondingly provided with two spring fixing parts respectively adopting protrusions or grooves, and the two spring fixing parts are connected with each other to fix elastic parts.

5. The rotatable and adjustable dumbbell according to claim 1, wherein the at least one inner guide groove comprises two side plates arranged opposite to each other, and the at least one connecting protrusion is inserted into a gap between the two side plates.

* * * * *